US010316518B2

(12) United States Patent
Patki et al.

(10) Patent No.: US 10,316,518 B2
(45) Date of Patent: Jun. 11, 2019

(54) GLAZED PORCELAIN ROOF TILE

(71) Applicant: Mohawk Carpet LLC, Calhoun, GA (US)

(72) Inventors: Rahul Patki, Richardson, TX (US); Terry Adams, Dallas, TX (US); Raul Rodriguez, Dallas, TX (US); Claudio Caselli, Dallas, TX (US)

(73) Assignee: DALTILE CORPORATION, Dallas, TX (US)

( * ) Notice: Subject to any disclaimer, the term of this patent is extended or adjusted under 35 U.S.C. 154(b) by 0 days.

(21) Appl. No.: 15/013,248

(22) Filed: Feb. 2, 2016

(65) Prior Publication Data

US 2017/0218632 A1 Aug. 3, 2017

Related U.S. Application Data

(60) Provisional application No. 62/288,675, filed on Jan. 29, 2016.

(51) Int. Cl.

| | |
|---|---|
| ***E04D 1/16*** | (2006.01) |
| ***E04D 1/26*** | (2006.01) |
| ***E04D 1/28*** | (2006.01) |

(52) U.S. Cl.

CPC ..... *E04D 1/16* (2013.01); *E04D 1/265* (2013.01); *E04D 1/28* (2013.01)

(58) Field of Classification Search

CPC ..... E04D 1/04; E04D 1/16; E04D 2001/3467; B28B 11/001; H02S 20/25

USPC ..... 52/519

See application file for complete search history.

(56) References Cited

U.S. PATENT DOCUMENTS

| | | | | |
|---|---|---|---|---|
| 3,796,618 | A * | 3/1974 | Lehming | C04B 41/009 156/230 |
| 5,671,577 | A | 9/1997 | Todd | |
| 5,935,885 | A * | 8/1999 | Hnat | C03B 3/02 106/DIG. 1 |
| 7,596,919 | B1 * | 10/2009 | Vande Hey | E04D 1/20 52/314 |
| 7,736,557 | B2 * | 6/2010 | Evans | B28B 11/001 264/132 |
| 8,507,098 | B2 * | 8/2013 | Long | C03C 3/083 428/426 |
| 2005/0284339 | A1 * | 12/2005 | Brunton | C04B 28/02 106/713 |
| 2008/0302050 | A1 * | 12/2008 | Kalkanoglu | B29C 44/1271 52/533 |
| 2010/0032086 | A1 * | 2/2010 | Hwang | B28B 11/001 156/268 |

(Continued)

FOREIGN PATENT DOCUMENTS

| | | |
|---|---|---|
| CN | 2173688 Y | 8/1994 |
| JP | H10-194819 A | 7/1998 |
| WO | 2015034366 A2 | 3/2015 |

OTHER PUBLICATIONS

International Search Report and Written Opinion of the International Searching Authority for related International Patent Application No. PCT/US2017/015217 dated Jun. 16, 2017.

(Continued)

*Primary Examiner* — Brian E Glessner
*Assistant Examiner* — Daniel J Kenny
(74) *Attorney, Agent, or Firm* — Troutman Sanders LLP; Alexis N. Simpson; Chris N. Davis

(57) ABSTRACT

Roof tile for forming a roof covering, wherein the roof tile (1) comprises a ceramic body (8); wherein said ceramic body (8) is made of porcelain; and wherein the roof tile (1) further comprises a glaze coating (9), which is situated above said ceramic body (8).

14 Claims, 9 Drawing Sheets

(56) References Cited

U.S. PATENT DOCUMENTS

| | | | | |
|---|---|---|---|---|
| 2012/0085053 | A1 | 4/2012 | Barone | |
| 2012/0148806 | A1* | 6/2012 | Dubey | B28B 19/0092 428/193 |
| 2013/0031864 | A1* | 2/2013 | Schools | E04D 1/16 52/519 |
| 2016/0319554 | A1* | 11/2016 | Thiers | B44C 1/24 |

OTHER PUBLICATIONS

"Vivaldi", Lea Ceramiche, Jan. 2013 [retrieved Jun. 26, 2017]; retrieved from the Internet <URL: http://www.readingrock.com/sites/default/files/Vivaldi_lux.pdf>.

"Builder's Show: Boral's hail-resistant concrete roof tiles", Consumer Reports News, Jan. 24, 2013 [retrieved Jun. 26, 2017]; retrieved from the Internet <URL: http://www.boralamerica.com/roofing/about/news/hail-resistant-roof-tiles>.

"Is it Really Porcelain?", Griese B, Feb. 2008 [retrieved Jun. 26, 2017]; retrieved from the Internet <URL: http://www.tcnatile.com/images/pdfs/ls%20lt%20Really%20Porcelain.pdf>.

ASTM C373—88 (Reapproved 2006), Standard Test Method for Water Absorption, Bulk Density, Apparent Porosity, and Apparent Specific Gravity of Fired Whiteware Products, Feb. 2006.

International Preliminary Report on Patentability dated Jul. 31, 2018 in related International Patent Application No. PCT/US2017/015217, 7 pages.

* cited by examiner

GLAZED PORCELAIN ROOF TILE

CROSS-REFERENCE TO RELATED APPLICATIONS

This application, filed Feb. 1, 2016, under 35 U.S.C. § 119(e), claims the benefit of U.S. Provisional Patent Application Ser. No. 62/288,675, filed Jan. 29, 2016, entitled "Roof tile for forming a roof covering, method for manufacturing a roof tile and method for installing roof tiles," the entire contents and substance of which are hereby incorporated by reference as if fully set forth below.

TECHNICAL FIELD

The present invention relates to a roof tile for forming a roof covering, a method for manufacturing a roof tile and a method for installing roof tiles. More particularly, the present invention relates to a roof tile for forming a roof covering, of the type wherein the roof tile comprises a ceramic body.

BACKGROUND

Such type of roof tile is known in the art. It is well-known for the body of such type of roof tile to be formed by a ceramic body of the so-called red body type such as a ceramic body made of terracotta. However, with such kind of materials, the weather/frost resistance and durability of the roof tile may be rather limited.

US 2012/0085053 A1 proposes the use of porcelain for such type of roof tile. Here, the roof tile is a lightweight tile, wherein, to reduce the weight, a plurality of ribs with intermittent recesses are provided at the lower surface of the roof tile. The upper surface of the roof tile may show conventional decorative textures and the decorative aspect of the roof tile is largely defined by the color of the ceramic body. Due to the particular configuration of the lower surface of the roof tile, its structure is relatively complex. Consequently, the roof tile is relatively difficult to manufacture.

BRIEF SUMMARY

The present invention aims in the first place at an alternative roof tile for forming a roof covering, of the aforementioned type, whereby, according to various preferred embodiments, solutions are offered for problems with roof tiles known in the art.

Hereto, the present invention, according to a first independent aspect, relates to a roof tile for forming a roof covering, of the aforementioned type, with the characteristic that the ceramic body is made of porcelain, and that the roof tile further comprises a glaze coating, which is situated above said ceramic body. Hereby, it is noted that the glaze coating is not necessarily situated directly above the ceramic body, however, this is preferably the case.

Because the ceramic body is made of porcelain, the advantage is obtained that the roof tile shows excellent properties in terms of weather and frost resistance. The body material is namely much less porous than materials such as earthenware or clay. Hence, the risk at water penetrating the body is significantly reduced.

Next to the body having low porosity, the glaze coating, which is situated above said ceramic body, nearly is non-porous. Consequently, the glaze coating contributes to the overall weather and frost resistance of the roof tile, since water can mainly only be absorbed via the edges of the roof tile.

Due to the very low porosity of the ceramic body, the advantage is also obtained that the glaze coating adheres very well to the body. Hence, the risk at pieces or parts of the glaze coating coming loose or breaking off, is significantly reduced.

Moreover, since porcelain has high mechanical strength and durability, the roof tile is stronger and more durable than roof tiles made of materials such as earthenware, clay, wood or slate.

Another advantage is that the roof tile, due to the presence of the glaze coating, may be provided with a variety of textures, designs and colors.

Other advantages that may be obtained by the presence of the glaze coating are the prevention or at least the minimization of moss grow, easy cleanability and/or UV-resistance.

Furthermore, the inventor has found that the roof tile may have a water absorption rate of less than 0.5% measured according to the norm ASTM C373. The hail impact rating of the roof tile may be of class 3 or higher measured according to the norm FM 4473.

In a preferred embodiment, said glaze coating comprises a décor, which may simulate a natural product such as stone, natural slate or wood. In the latter case, the décor may show wood grains or wood nerves.

As advantage, the roof tile may have the look of a natural product such as natural slate or wood, while being provided with better weather and frost resistance than roof elements that are actually made of such materials.

In a particular embodiment, said décor comprises a print. In other words, the décor, or at least part of the décor, is provided by means of a printer or printing machine.

Various techniques may be used to provide said print, such as screen printing, rotary serigraphy or digital printing, the latter technique being the preferred one. In case of digital printing, an inkjet printer may be used, which may be of the single pass type. In particular, a device similar to the one disclosed in EP 1 038 689 A1 may be used, wherein each roof tile is printed separately with a single pass of the roof tile underneath the fixed print heads of the device. With such device, the possibility is offered to print in certain areas of the upper surface of the roof tile. For example, the device may be used to print multiple images, each of these images being present in respective areas of the upper surface of the roof tile. These images may be separated from each other by means of intermediate lines, transitions or edges, which are not necessarily provided by means of printing, although this is not excluded.

In an embodiment, the upper surface of the roof tile is provided with a relief, which preferably is formed by a plurality of excavations present in said upper surface of the roof tile. By the relief, the texture of the roof tile, at the upper surface thereof, may simulate the texture of a natural product such as stone, natural slate or wood. In the latter case, the relief may for example simulate the texture of wood grains or wood pores.

The relief or at least part of the relief may also concern one or more chamfers present at the upper surface of the roof tile, which may be provided at one or more edges of the roof tile. For example, the relief or at least part thereof may concern a chamfered perimeter of the roof tile.

In case of a décor with multiple images, the relief may also be used to represent lines or transitions between these images. For example, these lines or transitions may be represented in the form of depressions in the upper surface of the roof tile, situated between the images.

Various possibilities may be applied for providing the relief. Preferably, the relief is formed in the upper surface of the ceramic body, in which case the relief manifests itself through the glaze coating up to the upper surface of the roof tile. Alternatively, the relief or at least part of the relief may be formed in the glaze coating, such that it is situated substantially or completely above the ceramic body.

In case of said glaze coating being provided with a print, said relief may be performed "in register" with said print, which means that the relief is in alignment with the print.

By having the relief "in register" with the print, the natural look or appearance of natural products such as wood or natural slate is better simulated. For example, in case the print is a wood pattern with lines simulating wood grains, the relief may be formed by lines following the course of said lines of the printed wood pattern or by a plurality of successive dashes having a configuration following the lines of the printed wood pattern.

For having the relief being performed "in register" with the print, the techniques known from WO 2015/092745 A1 may be used.

In a particular embodiment, the lower surface of the roof tile may be provided with a relief. The relief or at least part of the relief at the lower surface preferably concerns one or more chamfers or tapers present at the lower surface of the roof tile, which may be provided at one or more edges of the roof tile. For example, the relief or at least part thereof may concern a chamfered perimeter at the lower surface of the roof tile.

Preferably, the front face of the roof tile represents or forms an image of a plurality of roof tiles. In such case, the roof covering may have the appearance of a conventional one, however, with the advantage of being composed of fewer roof tiles. That the roof covering is composed of fewer roof tiles allows reducing the overall risk at water penetration. Indeed, the amount of joints, present between the roof tiles in the roof covering, in which water might penetrate, may be minimized.

For forming such kind of front face, a décor with multiple images may be applied, e.g. with each image representing a single roof tile. These multiple images may be provided by respectively printing in certain areas of the upper surface of the roof tile, as previously described. Thereto, a device such as the device known from EP 1 038 689 A1 may be applied.

In such front face, the borders or transitions between adjacent images of roof tiles may be represented by means of a relief. For example, as previously described, these borders or transitions may be formed by means of depressions in the upper surface of the roof tile, situated between the images of the roof tiles.

In a preferred embodiment, the glaze coating comprises a glaze layer of uniform color, which, in case of said glaze coating comprising a print, is situated below said print. As advantage, the glaze layer of uniform color may hide imperfections in the upper surface of the ceramic body.

Although the glaze layer of uniform color is preferably of a white, beige or grey color, the glaze layer may be of another color as well. In the latter case, the advantage may be obtained that the ink lay-up, which is needed for obtaining the desired colors in the aforementioned print, can be lowered.

Preferably, the glaze coating comprises a transparent or translucent glaze layer, which, in case of said glaze coating comprising a print, is arranged over said print. By having such glaze layer, the advantage may be obtained that the print can be protected from wear. Other advantages that may be obtained by the use of such transparent or translucent glaze layer are the minimization of moss grow, easy cleanability and/or UV-resistance.

It is noted that the aforementioned glaze coating may be a so-called wet or dry glaze.

In a particular embodiment, the color or appearance of the ceramic body substantially matches the color or appearance of the front face of the roof tile. As advantage, no major color or appearance differences are visible between for example the edges of the ceramic body and the front face of the roof tile.

Especially in case of the glaze coating being provided with a print, it is advantageous that the ceramic body substantially matches the general color or appearance of that print. Indeed, in that way, any substantial contrast between the edges of the ceramic body and the print may be excluded.

For accomplishing that goal, the ceramic body may be provided with one or more color pigments. The pigments may then be chosen such that they provide the ceramic body with a color or appearance that substantially matches the color or appearance of the front face of the roof tile.

It is noted that, in general, the ceramic body may be provided with one or more color pigments, irrespective of the ceramic body substantially matching the color or appearance of the front face of the roof tile.

In a preferred embodiment, the roof tile comprises a reinforcement layer, which is situated below the ceramic body and preferably directly below the ceramic body, although it is not excluded that the reinforcement layer is not situated directly below the ceramic body. It is noted that in the case of the reinforcement layer being situated directly below the ceramic body, it is not excluded that an adhesive layer such as glue is provided between the reinforcement layer and the ceramic body.

Because of the reinforcement layer, the advantage is obtained that the roof tile is prevented from falling apart, or that the risk of the roof tile falling apart is at least reduced. Such layer may for instance hold pieces or parts of the roof tile, which are damaged or broken off, due to heavy wind or storm for example, together. Hence, the overall safety of the roof is increased.

It is noted that, since the ceramic body is made of porcelain, such reinforcement layer is particularly advantageous. Although the porcelain body is very strong, when damage occurs, the body may break in many different parts. Hence, in such situation, it is beneficial that these are kept together such that the roof tile does not fall apart.

Preferably, the reinforcement layer is formed by a mesh, such as a fiberglass mesh.

In an alternative, the reinforcement layer is formed by a relatively thin support layer, i.e. a support layer which is thinner than the ceramic body. For example, the thin support layer may be a support slab such as a steel foil. The support slab may be glued to the ceramic body, directly or indirectly, for example in accordance with WO 2010/072704 A1. Preferably, a compression is obtained in the roof tile, resulting into higher impact strength. In this way, high impact hail rating may be obtained, possibly with a reduced thickness of the ceramic body of the roof tile, which may be beneficial to the overall weight of the roof tile.

Preferably, the thickness of the roof tile is located between 5 and 20 mm, and more preferably between 8 and 15 mm, whereby a thickness of approximately 11 mm is still more preferred. Such thickness provides a good balance between, on the one hand, the weight of the roof tile, and, on the other hand, the strength of the roof tile. In particular, a thickness of about 11 mm has been found to be beneficial for the hail impact rating of the roof tile.

In a preferred embodiment, the ceramic body forms at least 50%, more preferably at least 75%, and still more preferably at least 90% of the thickness of the roof tile. In that way, the roof tile has optimal advantage of the beneficial characteristics of porcelain.

The inventor has found that the roof tile may be made relatively wide. For example, the width of the roof tile may be larger than its length. Also, not necessarily combined with the previous, the roof tile may be at least 350 mm wide and preferably at least 500 mm wide. That the roof tile may be made relatively wide, offers the advantage that the roof or roof covering may be composed of a relatively small amount of roof tiles, thereby minimizing the amount of joints present in the roof covering and consequently the risk at water penetration.

The roof tile is preferably provided with at least one attachment hole. Such attachment hole is used to attach or fasten the roof tile to a supporting structure or framework of the roof, said framework for instance being formed by battens.

As advantage, the attachment hole allows a safe and secure installation of the roof tile, for example by using nails, screws or wires. Moreover, the attachment hole allows a simple and efficient way to install the roof tile.

In an embodiment, the attachment hole is present in at least the ceramic body of the roof tile. Accordingly, for example when using nails or screws, pressure is exerted onto the ceramic body for attaching it to the roof framework. Due to the ceramic body being made of porcelain, the risk at any damage or breakage of the roof tile, resulting from that pressure, may be minimized.

The attachment hole is preferably situated closer to the upper edge of the roof tile than to the lower edge of the roof tile. Still more preferably, the attachment hole is situated at a distance from the upper edge of the roof tile, as measured in the length direction of the roof tile, which is smaller than 0.25 times the length of the roof tile. As advantage, the extent of overlap between adjacent roof tiles in subsequent rows of the roof covering may be minimized.

Preferably, the roof tile is provided with a multiplicity of attachment holes.

Apart from using nails, screws or wires, other ways may be used for attaching or fastening the roof tile to the framework of the roof, not necessarily requiring that the roof tile is provided with one or more attachment holes as described hereinabove. For example, the roof tile may be hung on the framework of the roof by using battens and hangers. In another example, the roof tile may be installed by applying glue or adhesive.

In a preferred embodiment, the roof tile comprises a layer, which is situated below the ceramic body. It is noted that the layer situated below the ceramic body is not necessarily situated directly below the ceramic body, however, this is preferably the case. It is further noted that, in case of said layer being situated directly below the ceramic body, it is not excluded that an adhesive layer such as glue is present between said layer and the ceramic body.

The layer situated below the ceramic body may provide additional functionalities to the roof tile. As advantage, it may be tailored, irrespective of the properties of the ceramic body. As another advantage, the layer may render it possible to reduce the thickness of the ceramic body, which may be beneficial to the overall weight of the roof tile. Still another advantage is that such layer may hold pieces or parts of the roof tile, which are damaged or broken off, due to heavy wind or storm for example, together. Said layer may thus function as a reinforcement layer.

Preferably, said layer situated below the ceramic body is made of a material different from ceramic or porcelain. In particular, said layer may be made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer. In case polyethylene is used as a material for said layer, high-density polyethylene or HDPE is preferred, although the use of low-density polyethylene or LDPE is not excluded.

In case of said layer situated below the ceramic body being made of a polymer, the layer may comprise a filler, such as an inorganic filler, e.g. chalk, talc or limestone, and/or an organic filler, e.g. wood, cork or bamboo particles.

If said layer situated below the ceramic body is made of a polymer, the layer may comprise one or more plasticizers. The one or more plasticizers may be present in an amount of less than 20 phr and, in this case, preferably in an amount between 5 phr and 15 phr. In this case, the layer is of the so-called rigid type. In an alternative, the one or more plasticizers may be present in an amount of minimal 15 phr and, in this case, preferably in an amount of minimal 20 phr. In this case, the layer is of the so-called soft type.

In a particular embodiment, said layer situated below the ceramic body may be foamed.

Said layer situated below the ceramic body may comprise a reinforcement layer, which is preferably embedded in the layer situated below the ceramic body. The reinforcement layer may concern a fiberglass layer, a mat or a fabric. As advantage, the reinforcement layer allows to increase the mechanical strength of the layer situated below the ceramic body and/or the stability thereof.

In a particular embodiment, said layer situated below the ceramic body may comprise mineral fibers, such as glass fibers, which are not necessarily present in said layer situated below the ceramic body in the form of a layer. For example, the mineral fibers may be present in said layer situated below the ceramic body in the form of fibers that are distributed across the layer situated below the ceramic body. The presence of mineral fibers offers the advantage that the mechanical strength and/or stability of the layer situated below the ceramic body may be increased.

The ceramic body and the layer situated below said ceramic body may be laminated or press laminated together, directly or indirectly, for example by means of glue such as epoxy glue.

As mentioned previously, due to the presence of said layer, the advantage is obtained that the thickness of the ceramic body may be reduced, however, with maintaining a good strength, durability and/or weather/frost resistance. Preferably, in case such layer is present, the thickness of the ceramic body is located between 25% and 75% of the thickness of the roof tile and more preferably between 40% and 60% of the thickness of the roof tile. The thickness of the layer situated below the ceramic body is preferably located between 25% and 75% and more preferably between 40% and 60% of the thickness of the roof tile.

In an embodiment, at least a part of the layer situated below the ceramic body extends beyond the ceramic body in at least the length direction of the roof tile. For example, the ceramic body and said layer may be offset with respect to each other in at least the length direction of the roof tile. Preferably, at least a part of the layer situated below the ceramic body extends beyond at least the upper edge of the ceramic body. In this case, at least a part of the ceramic body may extend beyond at least the lower edge of said layer. In this way, it is obtained that the ceramic bodies of two of such roof tiles, installed in subsequent rows of the roof covering, may overlap, such that mainly only the ceramic bodies are exposed to outside conditions. This offers the advantage that the roof covering shows good properties in terms of weather and frost resistance. As another advantage, the amount of overlap between the ceramic bodies of two of such installed roof tiles in subsequent rows may be reduced.

In an embodiment, at least a part of the layer situated below the ceramic body extends beyond the ceramic body in at least the width direction of the roof tile. For example, the ceramic body and said layer may be offset with respect to each other in at least the width direction of the roof tile. As advantage, it is obtained that the risk at water penetration may be reduced, since water penetrating the joint between two of such adjacent roof tiles in the same row of the roof covering may be caught by the underlying layers. Preferably, at least a part of the layer situated below the ceramic body extends beyond at least a side edge of the ceramic body, in the direction wherein multiple of such roof tiles are installed in a row of the roof covering. In this case, at least a part of the ceramic body may extend beyond at least a side edge of said layer, in the opposite direction. This provides the additional advantage of ease of installation.

It is noted that at least part of the layer situated below the ceramic body may extend beyond the ceramic body in the length direction of the roof tile as well as in the width direction of the roof tile. For example, said layer may be offset with respect to the ceramic body in the length direction of the roof tile as well as in the width direction of the roof tile.

Preferably, the upper and lower surface of said layer converge towards each other. In particular, they may converge towards each other in the direction towards the upper edge of said layer. For example, the upper surface of said layer may be substantially parallel to the lower surface of the ceramic body, whereas the lower surface of said layer may be configured such that, in the installed condition of the roof tile, it is substantially parallel to the slope of the roof. As advantage, the risk at breakage or damage of the roof tile, e.g. when walking over it, may be significantly reduced. In a particularly preferred embodiment, the lower surface of said layer is arranged such that, in the installed condition of two of such roof tiles in subsequent rows of the roof covering, the lower surfaces of the respective layers of these two roof tiles form a generally flat surface. In other words, the transition from the lower surface of the layer of one roof tile of these two roof tiles to the lower surface of the layer of the other roof tile is flush or substantially flush.

It is noted that in case of such converging surfaces the thickness of said layer varies. In this case, where reference is made to the thickness of said layer, this thickness should be interpreted as the average thickness of said layer. The same applies to the thickness of the roof tile.

In a first possibility for the configuration of the layer situated below the ceramic body, at least a part of said layer extends beyond the ceramic body, which part is provided with one or more attachment holes. As such, the presence of any attachment holes in the ceramic body may be avoided, hereby reducing the risk at breakage or damage of the ceramic body upon installing. The layer may be tailored, irrespective of the ceramic body, such that it is strong enough to withstand any forces or pressure applied on it upon installing. In this regard, the aforementioned materials for the layer are particularly advantageous.

In particular, at least a part of said layer may extend beyond the upper edge of the ceramic body, which part is provided with one or more attachment holes.

The one or more attachment holes are preferably situated closer to the upper edge of the roof tile than to the lower edge of the roof tile. Still more preferably, the one or more attachment holes are situated at a distance from the upper edge of the roof tile, as measured in the length direction of the roof tile, which is smaller than 0.25 times the length of the roof tile. As advantage, the extent of overlap between adjacent roof tiles in subsequent rows of the roof covering may be minimized.

In a second possibility for the configuration of the layer situated below the ceramic body, said layer, at least at two opposite edges, is provided with coupling parts, which allow that two of such roof tiles can be coupled to each other. Hereby, the advantage of easy installation is obtained, since the coupling parts may hold the roof tile in place for attaching or fastening it to the framework of the roof. As another advantage, the risk at water penetration may be reduced, since the formation of gaps between roof tiles may be counteracted. Other advantages that may be obtained are improved impact resistance, improved uplift wind resistance and/or improved thermal insulation.

Preferably, the opposite edges, at which the coupling parts are provided, concern the upper and lower edges of the layer situated below the ceramic body. In this case, the coupling parts allow coupling two of such roof tiles lying adjacent to each other in subsequent rows of the roof covering.

In an alternative, the opposite edges, at which the coupling parts are provided, concern the opposite side edges of the layer situated below the ceramic body. In this case, the coupling parts allow coupling two of such roof tiles lying adjacent to each other in a row of the roof covering.

It is noted that the upper and lower edges as well as the opposite side edges of the layer situated below the ceramic body may be provided with coupling parts.

In an embodiment, one of the opposite edges, with its associated coupling part, is situated, partially or completely, beyond the ceramic body, whereas the ceramic body extends, partially or completely, beyond the other edge of said opposite edges. In case the upper and lower edges as well as the opposite side edges of said layer are provided with coupling parts, both pairs of edges may show the latter characteristic.

The aforementioned coupling parts may be performed according to one or more of the following possibilities, inasmuch these are not contradictory:

- the coupling parts are provided with a locking system, which, in the coupled condition of two of such roof tiles, is only active in the direction parallel to the plane of the roof covering and perpendicular to the coupled edges, which means that the moving apart of two of such coupled roof tiles in said direction is counteracted and preferably prevented. In an example, the coupling parts concern hook-shaped parts.
- the coupling parts are provided with a locking system, which, in the coupled condition of two of such roof tiles, is only active in the direction perpendicular to the plane of the roof covering, which means that the moving apart of two of such coupled roof tiles in said direction is counteracted and preferably prevented. In an example, the coupling parts concern a classical tongue and groove coupling.

the coupling parts are provided with a locking system, which, in the coupled condition of two of such roof tiles, is active in the direction parallel to the plane of the roof covering and perpendicular to the coupled edges as well as in the direction perpendicular to the plane of the roof covering, which means that the moving apart of two of such coupled roof tiles in said directions is counteracted and preferably prevented;

the coupling parts are free from locking systems. In an example, these coupling parts define an overlap between the respective layers of two of such coupled roof tiles.

the coupling parts provide for a click-type or snap-type coupling;

the coupling parts are configured such that they allow to couple two of such roof tiles by means of a downward movement of one roof tile with respect to the other, such as coupling parts of the so-called push-lock or push-down type, known per se from the field of flooring;

the coupling parts are configured such that they allow to couple two of such roof tiles by means of a sliding movement one roof tile with respect to the other along the direction of the opposite edges, such as coupling parts of the dove-tail type.

In case of coupling parts being present at the upper and lower edges as well as at the opposite side edges of the layer situated below the ceramic body, the coupling parts at the upper and lower edges may be of a different type than the coupling parts at the side edges, however, they may be identical as well.

Preferably, the coupling parts are substantially or completely formed from the material of the layer situated below the ceramic body. It is noted that the aforementioned materials for said layer show excellent properties for this purpose.

In an embodiment, the coupling parts may form channels for the drainage of water.

It is noted that the aforementioned two possibilities for the configuration of the layer situated below the ceramic body may be combined.

It is noted that the characteristic that the roof tile is provided with a décor, said décor comprising a print, forms an inventive idea, irrespective of the roof tile comprising a glaze coating, and that said characteristic may be beneficially applied to a roof tile of the aforementioned type, wherein the ceramic body is made of porcelain. Hence, the present invention, according to a second independent aspect, relates to a roof tile for forming a roof covering, of the aforementioned type, with the characteristic that the ceramic body is made of porcelain, and that the roof tile is provided with a décor, which preferably simulates a natural product such as stone, natural slate or wood, said décor comprising a print. As advantage, with the print, the roof tile may simulate a natural product such as slate or wood, however, with having the beneficial properties of porcelain, which have been elucidated in regard to the first aspect of the invention. It is noted that this second aspect may be combined with any of the characteristics of the first aspect, irrespective of the roof tile comprising a glaze coating, inasmuch these combinations do not result in any contradiction.

It is further noted that the characteristic that the roof tile comprises a reinforcement layer, which is situated below said ceramic body, forms an inventive idea, irrespective of the ceramic body being made of porcelain and irrespective of the roof tile comprising a glaze coating, and that said characteristic may be beneficially applied to a roof tile of the aforementioned type. The present invention, according to a third independent aspect, therefore relates to a roof tile for forming a roof covering, of the aforementioned type, with the characteristic that the roof tile comprises a reinforcement layer, which is situated below said ceramic body. Said reinforcement layer may be formed by a mesh, preferably a fiberglass mesh, or a relatively thin support layer, such as a support slab, e.g. a steel foil, as previously described in relation to the first aspect. As advantage, the roof tile is prevented from falling apart, or the risk of the roof tile falling apart is at least reduced. Such reinforcement layer may for instance hold pieces or parts of the roof tile, which are damaged or broken off due to heavy wind or storm, together. Hence, the overall safety of the roof is increased. It is noted that this third aspect may be combined with any of the characteristics of the first aspect, irrespective of the ceramic body being made of porcelain and irrespective of the roof tile comprising a glaze coating, inasmuch these combinations do not result in any contradiction.

Furthermore, it is noted that the characteristic that the width of the roof tile is larger than its length forms an inventive idea, irrespective of the ceramic body being made of porcelain, and the roof tile comprising a glaze coating, and that said characteristic may be beneficially applied to a roof tile of the aforementioned type. Hence, the present invention, according to a fourth independent aspect, relates to a roof tile for forming a roof covering, of the aforementioned type, with the characteristic that the width of the roof tile is larger than its length. As advantage, the roof or roof covering may be composed of a relatively small amount of roof tiles, thereby minimizing the amount of joints present in the roof covering and consequently the risk at water penetration. More particularly, the roof tile of the fourth aspect may be at least 350 mm wide and preferably at least 500 mm wide. Because of the width being larger than the length, the front face of the roof tile may represent or form an image of a plurality of roof tiles. As previously mentioned, in this way, the advantage is obtained that the roof covering may have the appearance of a conventional one, however, with the advantage of being composed of fewer roof tiles, and having a lower risk at water penetration. It is noted that this fourth aspect may be combined with any of the characteristics of the first aspect, irrespective of the ceramic body being made of porcelain, and the roof tile comprising a glaze coating, inasmuch these combinations do not result in any contradiction.

It is also noted that the characteristic that the roof tile comprises a layer, which is situated below said ceramic body, said layer being provided with one or more attachment holes and/or with, at least at two opposite edges, coupling parts, forms an inventive idea, irrespective of the roof tile comprising a body made of ceramic or porcelain, and the roof tile comprising a glaze coating, and that said characteristic may be beneficially applied to a roof tile in general.

For that reason, the present invention, according to a fifth aspect, relates to a roof tile for forming a roof covering, with the characteristic that the roof tile comprises a first layer and a second layer, which is situated below the first layer, and which is made of a different material or a material with different material properties than the material of said first layer; and that the roof tile shows one or both of the following characteristics:

at least a part of said second layer extends beyond the first layer, which part is provided with one or more attachment holes; and/or said second layer, at least at two opposite edges, is provided with coupling parts, which allow that two of such roof tiles can be coupled to each other.

It is noted that the second layer is not necessarily situated directly below the first layer, however, this is preferably the case. It is further noted that, in case of the second layer being situated directly below the first layer, it is not excluded that an adhesive layer such as glue is provided between the first and second layer.

The advantage of having two layers made of different materials or materials with different properties is that each layer may be tailored to its own needs. For instance, the first layer may comprise a ceramic or porcelain layer, offering beneficial properties in terms of hardness, strength and weather/frost resistance. The second layer on the other hand may be made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer. Such materials allow the beneficial application of attachment holes and/or coupling parts, as previously described in relation the first aspect. In a preferred embodiment, the first and second layer are laminated or press laminated to each other, directly or indirectly, for example by means of glue such as epoxy glue. It is noted that said first layer may comprise a décor, such as a décor in the form of a print. In case of the first layer comprising a ceramic or porcelain layer, said first layer may comprise a glaze coating, which may show any of the characteristics of the glaze coating described in relation to the first aspect. It is noted that this fifth aspect may be combined with any of the characteristics of said first aspect, whereby the characteristics described, in the first aspect, in relation to the ceramic body may be applied to the first layer, this first layer not necessarily being or forming a ceramic body, and the characteristics described, in the first aspect, in relation to the layer situated below the ceramic body may be applied to the second layer, inasmuch these combinations do not result in any contradiction.

It is noted that, in the installed condition of the roof tile according to any of the first to fifth aspect of the invention, a membrane may be present below the roof tile. This membrane offers the advantage of preventing water penetration.

The present invention also relates to a method for manufacturing a roof tile, wherein the roof tile comprises a ceramic body, which is made of porcelain, and is provided with at least one hole, which is present in at least said ceramic body; wherein the method at least comprises the step of providing a body composition, the step of pressing the body composition, and the step of firing the pressed body composition; and wherein, for forming said at least one hole, before said step of firing, a recess is formed in the body in the form of a blind hole or a through hole.

Because such recess is formed before said step of firing, the advantage is obtained that, although porcelain is relatively strong, the formation of the hole is relatively easy. The roof tile namely gains its mechanical strength only after said step of firing. Also, the hole may be provided without any substantial risk at damaging the roof tile or negatively impacting the mechanical strength or other properties thereof.

In a practical embodiment, the body composition concerns body powder.

In a first possibility, before said step of firing, said recess is formed in the form of a blind hole, whereas, after said step of firing, a through hole is made from the blind hole, which through hole then corresponds to said at least one hole.

Preferably, in said first possibility, the blind hole that is formed prior to firing constitutes at least 50%, and more preferably at least 75%, and still more preferably at least 90% of the length of said at least one hole. In such case, the through hole can be made easily, since the remaining part of the hole can be taken away relatively easy.

The blind hole is preferably formed in said step of pressing. For example, the body composition may be pressed between an upper and a lower press element, which are provided with means for forming said blind hole. In particular, said means may be formed by at least one protrusion that is present at one of the press elements, preferably the upper one, the length of which being smaller than the thickness of the ceramic body. Preferably, the step of pressing is performed with the upper surface of the ceramic body facing upwards or, in other words, with the upper surface of the ceramic body facing towards the upper press element.

The through hole may be made from the blind hole, after said step of firing, by means of stamping. As alternative, the through hole may be made from the blind hole upon installing the roof tile, e.g. by punching/hammering a nail or turning a screw into the blind hole, which then removes the remaining part.

In a second possibility, before said step of firing, said recess is formed in the form of a through hole.

Preferably, said through hole is made in two stages. In a first stage, a blind hole is made, whereas, in a second stage, still prior to the step of firing, the through hole is made from the blind hole, which through hole then corresponds to said at least one hole. Said blind hole may be made in accordance with the formation of the blind hole in the aforementioned first possibility, preferably in said step of pressing. The through hole may be made from the blind hole by means of stamping.

In an alternative to the two-stage process, the through hole may be formed in one stage. For example, the through hole may be stamped into the pressed body composition, before said step of firing.

The method may further comprise the step of providing the roof tile with a layer situated below said ceramic body, preferably after said step of firing. It is noted that said layer is not necessarily situated directly below the ceramic body, however, this is preferably the case. It is further noted that in case of said layer being situated directly below the ceramic body, it is not excluded that an adhesive layer such as glue is provided between said layer and the ceramic body.

Said layer may concern any of the below the ceramic body situated layers described in relation to the first aspect of the invention, such as a reinforcement layer and/or a layer with coupling parts.

Preferably, said layer is provided by means of lamination or press lamination, preferably by means of glue such as epoxy glue.

In a preferred embodiment, said at least one hole is an attachment hole. As previously described, the term "attachment hole" is applied to indicate a hole that is used to attach or fasten the roof tile to the supporting structure or framework of the roof, for example by using nails, screws or wires or other means. Rather surprisingly, especially in view of the small diameter of width of such attachment hole and the high temperatures applied in said step of firing, it has been found that the method is eminently suitable for providing the attachment hole. In particular, the minimal width or diameter of the attachment hole may be smaller than the thickness of the roof tile.

The at least one hole is preferably situated closer to the upper edge of the roof tile than to the lower edge of the roof tile. Still more preferably, the at least one hole is situated at a distance from the upper edge of the roof tile, as measured in the length direction of the roof tile, which is smaller than 0.25 times the length of the roof tile. As advantage, the extent of overlap between adjacent roof tiles in subsequent rows of the roof covering may be minimized.

Preferably, the roof tile is provided with a multiplicity of such holes or such attachment holes.

It is noted that the characteristic that, for forming the attachment hole, before said step of firing, a recess is formed in the body in the form of a blind hole or a through hole, forms an inventive idea, irrespective of the ceramic body being made of porcelain. Hence, the present invention also relates to a method for manufacturing a roof tile, wherein the roof tile comprises a ceramic body, and is provided with at least one attachment hole, which is present in at least said ceramic body; wherein the method at least comprises the step of providing a body composition, the step of pressing the body composition, and the step of firing the pressed body composition; and wherein, for forming said at least one attachment hole, before said step of firing, a recess is formed in the body in the form of a blind hole or a through hole. It is noted that this method may comprise any of the characteristics of the previously described method, irrespective of the ceramic body being made of porcelain.

In a particular embodiment, the at least one attachment hole has a minimal width or diameter that is smaller than the thickness of the roof tile.

The at least one attachment hole is preferably situated closer to the upper edge of the roof tile than to the lower edge of the roof tile. Still more preferably, the at least one attachment hole is situated at a distance from the upper edge of the roof tile, as measured in the length direction of the roof tile, which is smaller than 0.25 times the length of the roof tile. As advantage, the extent of overlap between adjacent roof tiles in subsequent rows of the roof covering may be minimized.

It is noted that the hereinabove described methods may be applied for manufacturing a roof tile with any of the characteristics as described hereinabove in relation to any of the first to fifth aspect of the present invention.

Furthermore, the present invention relates to a method for installing roof tiles, wherein the method at least comprises the step of installing subsequent rows of roof tiles such that the roof tiles of one row partially overlap the roof tiles of a previous row; with the characteristic that the overlap between the roof tiles of two subsequent rows is less than 20%. Or, in other words, the roof tiles of one row partially overlap the roof tiles of a previous row, whereby the overlap is such that less than 20% of the upper surface of the roof tiles of the previous row is covered by the roof tiles of the one row.

Hereby, it is noted that, in case of a multi-layer roof tile, the upper surface of the roof tile denotes the upper surface of the uppermost layer of the roof tile. So, for example, in case of the roof tile comprising a ceramic body and a layer situated below the ceramic body, the upper surface of the roof tile denotes the upper surface of the ceramic body or, in case of a glaze coating situated above the ceramic body, the upper surface of the glaze coating. Mostly, the upper surface of the roof tile denotes the decorative surface of the roof tile.

Generally, the overlap between subsequent rows offers the advantage that water may flow downwards without leaking between the roof tiles. Further, in case the roof tiles are attached to the framework of the roof by means of metal parts such as nails or screws, these metal parts may be covered, such that they are hidden from view and from water to avoid corrosion. More particularly, by having the overlap being less than 20%, the roof covering may be composed of a relatively small amount of roof tiles, thereby minimizing the amount of joints present in the roof covering and consequently the risk at water penetration.

In a preferred embodiment, the roof tiles are at least 350 mm wide and more preferably at least 500 mm wide, the advantage being obtained that the amount of roof tiles needed for covering the roof is further reduced.

It is noted that said method for installing roof tiles may be used for installing roof tiles with any of the characteristics mentioned hereinabove in relation to first to fifth aspect of the present invention as well as for installing roof tiles that are manufactured according to the hereinabove described methods for manufacturing a roof tile.

It is noted that the roof tile of the present invention, as well as its body and/or any layers of the roof tile, are preferably mainly rectangular, in particular rectangular and oblong, although other geometrical forms or shapes are not excluded.

It is noted that the roof tile is installed on the roof with its width direction along the horizontal direction and with its length direction according to the direction along the slope of the roof.

It is noted that, in case of the roof tile, its body and/or any layers of the roof tile having a varying length, width and/or thickness, where reference is respectively made to the length, width or thickness thereof, this length, width or thickness should be interpreted as respectively the average length, average width or average thickness.

It is noted that, although the present invention primarily concerns a roof tile, any of the features described herein may be applied more generally to any kind of tile for exterior use, such as a tile for covering walls or a tile for siding.

BRIEF DESCRIPTION OF THE DRAWINGS

With the objective of better showing the characteristics of the invention, hereafter, as example without any limiting character, some preferred embodiments are described, with reference to the accompanying drawings.

DETAILED DESCRIPTION

Figure 1:
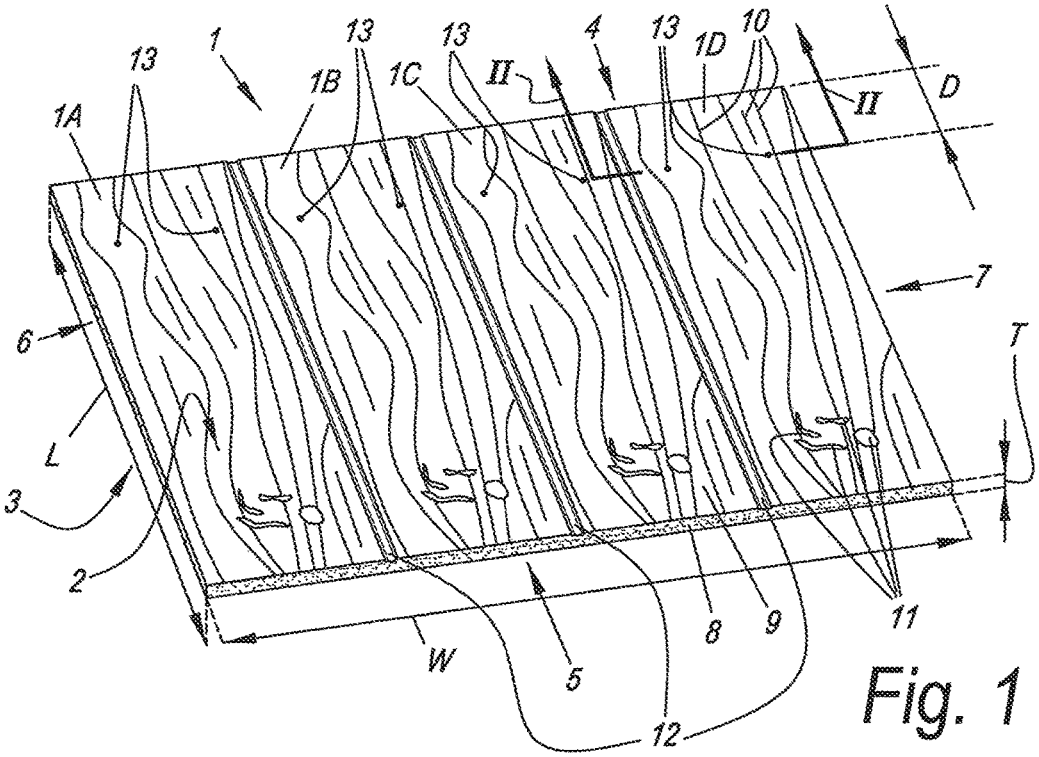
FIG. 1 represents a perspective view of a roof tile according to the present invention, with a view on the front face of the roof tile, in accordance with an exemplary embodiment of the disclosure.

FIG. 1 represents a perspective view of a roof tile 1 according to the present invention, with a view on the front face of the roof tile 1.

The roof tile 1 is mainly rectangular and, in the represented example, rectangular and oblong. It has an upper surface 2 and a lower surface 3, whereby, in the installed condition of the roof tile 1, the upper surface 2 is directed upwards, whereas the lower surface 3 is directed downwards. The upper surface 2 forms the decorative surface of the roof tile 1.

Furthermore, the roof tile 1 has an upper edge 4 and a lower edge 5, whereby, in the installed condition of the roof tile 1, the upper edge 4 is directed towards the top of the roof, whereas the lower edge 5 is directed towards the bottom of the roof. Also, the roof tile 1 has two opposite side edges 6-7.

The roof tile 1 comprises a ceramic body 8, which is made of porcelain, and a glaze coating 9, which is situated above said ceramic body 8.

The glaze coating 9 comprises a décor, which here simulates wood. In particular, the décor shows wood nerves 10 and wood pores 11.

In the represented example, the front face of the roof tile 1 represents or forms an image of a plurality of roof tiles 1A-1B-1C-1D. The borders or transitions between the roof tiles 1A-1B-1C-1D are formed by depressions 12, which form part of the relief at the upper surface 2 of the roof tile 1.

Although, in the represented example, the front face of the roof tile 1 represents or forms an image of four roof tiles 1A-1B-1C-1D, it is not excluded that less than four roof tiles are represented, such as two or three roof tiles, nor is it excluded that more than four roof tiles are represented.

The thickness T of the roof tile 1 is preferably located between 5 and 20 mm, more preferably between 8 and 15 mm, and still more preferably the thickness T of the roof tile 1 is approximately 11 mm.

The width W of the roof tile 1 is larger than its length L. The width W of the roof tile 1 may be at least 350 mm and preferably at least 500 mm.

The roof tile 1 is provided with at least one attachment hole 13. Here, the roof tile 1 is provided with a plurality of attachment holes 13. The attachment holes 13 are present in at least the ceramic body 8 of the roof tile 1. They are situated closer to the upper edge 4 of the roof tile 1 than to the lower edge 5 of the roof tile 1. In particular, the attachment holes 13 are situated at a distance D from the upper edge 4, measured in the length direction of the roof tile 1, which is smaller than 0.25 times the length L of the roof tile 1. The minimal width or diameter of the attachment holes 13 is smaller than the thickness T of the roof tile 1.

In a not represented embodiment, the lower surface 3 of the roof tile 1 may be provided with a relief, such as a chamfer or taper present at one of the edges 4-7 of the roof tile 1, at the lower surface 3. Preferably, the chamfer or taper is present at least at the lower edge 5 of the roof tile 1. Such chamfer at the lower edge 5 offers the advantage of the roof tile 1, according to a view on the lower edge 5, looking relatively thin, e.g. looking like a thin slate roof element, while being provided with better weather and frost resistance than roof elements that are actually made of such materials like slate.

Figure 2:
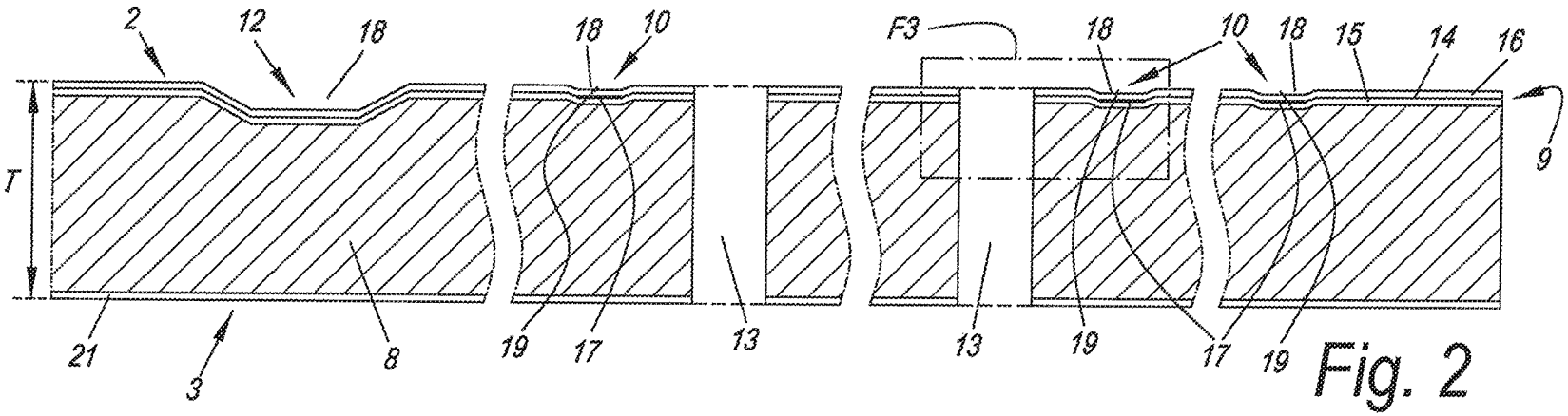
FIG. 2 represents an enlarged cross-section according to line II-II in FIG. 1, in accordance with an exemplary embodiment of the disclosure.

FIG. 2 represents an enlarged cross-section according to line II-II in FIG. 1.

In the represented example, the glaze coating 9 is situated directly above the ceramic body 8.

The ceramic body 8 forms at least 50%, more preferably at least 75% and still more preferably at least 90% of the thickness T of the roof tile 1.

The glaze coating 9 comprises a décor, said décor comprising a print 14, a glaze layer 15 of uniform color, which is situated below the print 14, and a transparent or translucent glaze layer 16, which is arranged over said print 14.

The print 14 is at least partially formed by lines 17 simulating the wood nerves 10.

The upper surface 2 of the roof tile 1 is provided with a relief, which, in the represented example, is formed by a plurality of excavations 18 present in said upper surface 2.

In the represented example, by the relief, the texture of the roof tile 1, at the upper surface 2 thereof, simulates the texture of wood. In particular, the relief simulates the texture of the wood nerves 10 and the wood pores 11. For example, the relief is at least partially formed by lines 19 simulating the wood nerves 11.

Here, the relief is also used to represent the borders or transitions between the roof tiles 1A-1B-1C-1D, which, as aforementioned, are formed by the depressions 12 in the upper surface 2 of the roof tile 1.

In the example, the relief is performed in register with the print 14. For example, the lines 19 of the relief follow the course of the lines 17 of the print 14.

Figure 3:
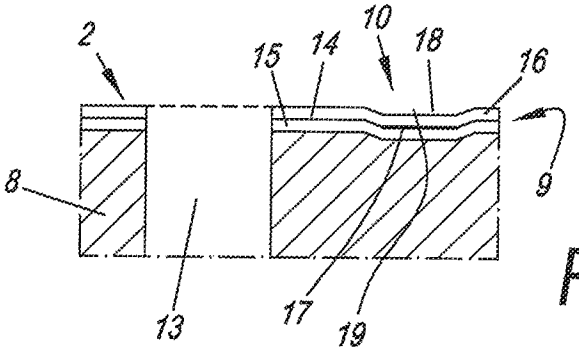
FIG. 3 represents an enlarged view of the section that is indicated with F3 in FIG. 2, in accordance with an exemplary embodiment of the disclosure.

FIG. 3 represents an enlarged view of the section that is indicated with F3 in FIG. 2, from which it is clear that the relief is formed in the upper surface 20 of the ceramic body 8, whereby the relief manifests itself through the glaze coating 9 up to the upper surface 2 of the roof tile 1.

Figure 4:
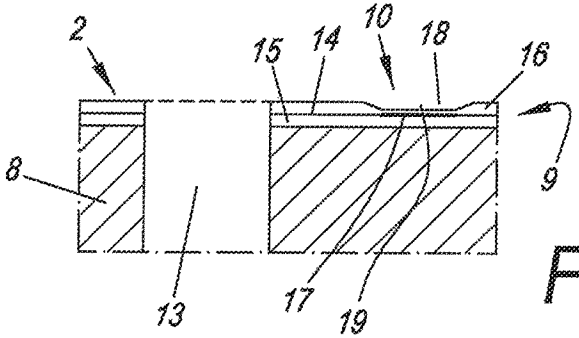
FIG. 4 represents an alternative to the embodiment of FIG. 3, in accordance with an exemplary embodiment of the disclosure.

FIG. 4 represents an alternative to the embodiment of FIG. 3, wherein the relief or at least part of the relief is formed in the glaze coating 9, such that it is situated substantially or completely above the ceramic body 8.

Figure 5:
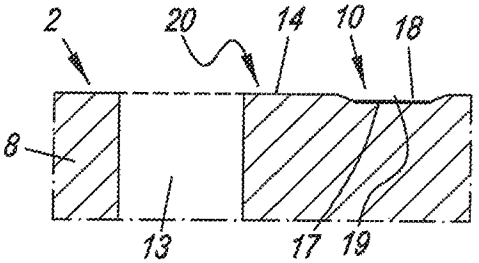
FIG. 5 represents another alternative to the embodiment of FIG. 3, in accordance with an exemplary embodiment of the disclosure.

FIG. 5 represents another alternative to the embodiment of FIG. 3, wherein a glaze coating is absent and wherein the print 14 and the relief are provided at the upper surface 20 of the ceramic body 8.

In such case, the print 14 may be provided directly on the upper surface 20 of the ceramic body 8 or, in an alternative, the print 14 may be provided on a primer or ground coat present at the upper surface 20 of the ceramic body 8. A primer or ground coat may be used for improving the adherence of the print 14 to the ceramic body 8. A primer or ground coat may also be used to create an even or substantially even surface, upon which the print 14 can be provided, which is especially useful in case the upper surface 20 of the ceramic body is irregular.

Figure 6:
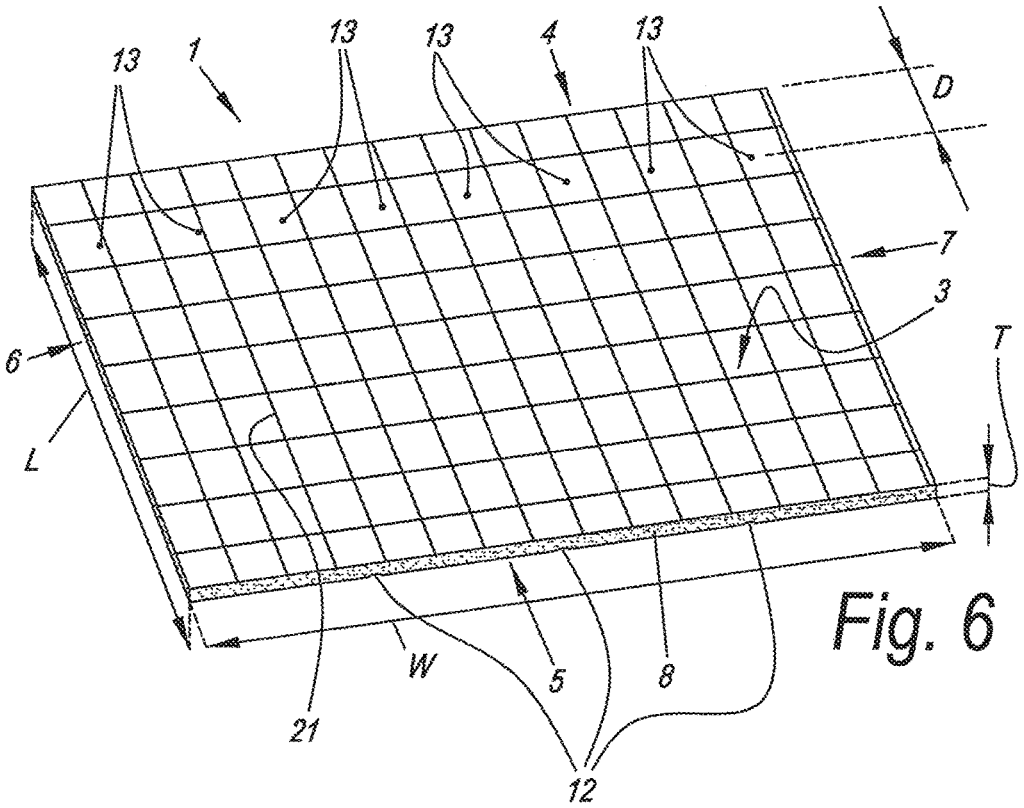
FIG. 6 represents a perspective view of the roof tile of FIG. 1, with a view on the back face of the roof tile, in accordance with an exemplary embodiment of the disclosure.

FIG. 6 represents a perspective view of the roof tile 1 of FIG. 1, with a view on the back face of the roof tile 1.

The roof tile 1 comprises a reinforcement layer 21, which is situated below the ceramic body 8.

In the represented example, the reinforcement layer 21 is situated directly below the ceramic body 8, whereby it is not excluded that an adhesive layer such as glue is present in between the reinforcement layer 21 and the ceramic body 8.

Here, the reinforcement layer 21 is formed by a mesh, preferably a fiberglass mesh.

Figure 7:
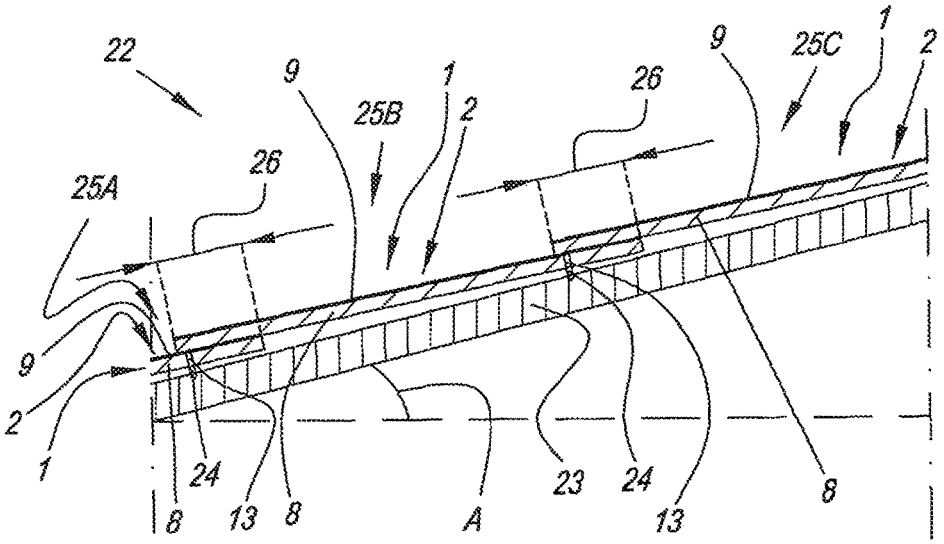
FIG. 7 represents a cross-sectional side view of part of an installed roof covering with roof tiles according to FIG. 1, in accordance with an exemplary embodiment of the disclosure.

FIG. 7 represents a cross-sectional side view of part of an installed roof covering 22 with roof tiles 1 according to FIG. 1.

The roof tiles 1 are attached or fastened to a framework 23 by means of nails 24, which are put in the attachment holes 13.

The roof tiles 1 are installed in subsequent rows, of which only a few are represented in FIG. 7, namely the subsequent rows 25A-25B-25C. In particular, the roof tiles 1 are installed such that the roof tiles 1 of one row partially overlap the roof tiles of a previous row.

For example, the roof tiles 1 of row 25C and 25B respectively overlap the roof tiles 1 of previous row 25B and 25A.

The overlap 26 between the roof tiles 1 of the respective rows is less than 20%. Or, in other words, the roof tiles 1 of row 25C and 25B respectively overlap the roof tiles 1 of previous row 25B and 25A, whereby the overlap 26 is such that less than 20% of the upper surface 2 of the roof tiles 1 of row 25A and 25B is covered by the roof tiles 1 of row 25B and 25C respectively.

A denotes the inclination of the roof with respect to the horizontal.

It is noted that the structure of the glaze coating 9 is not represented in detail in FIG. 7.

Figure 8:
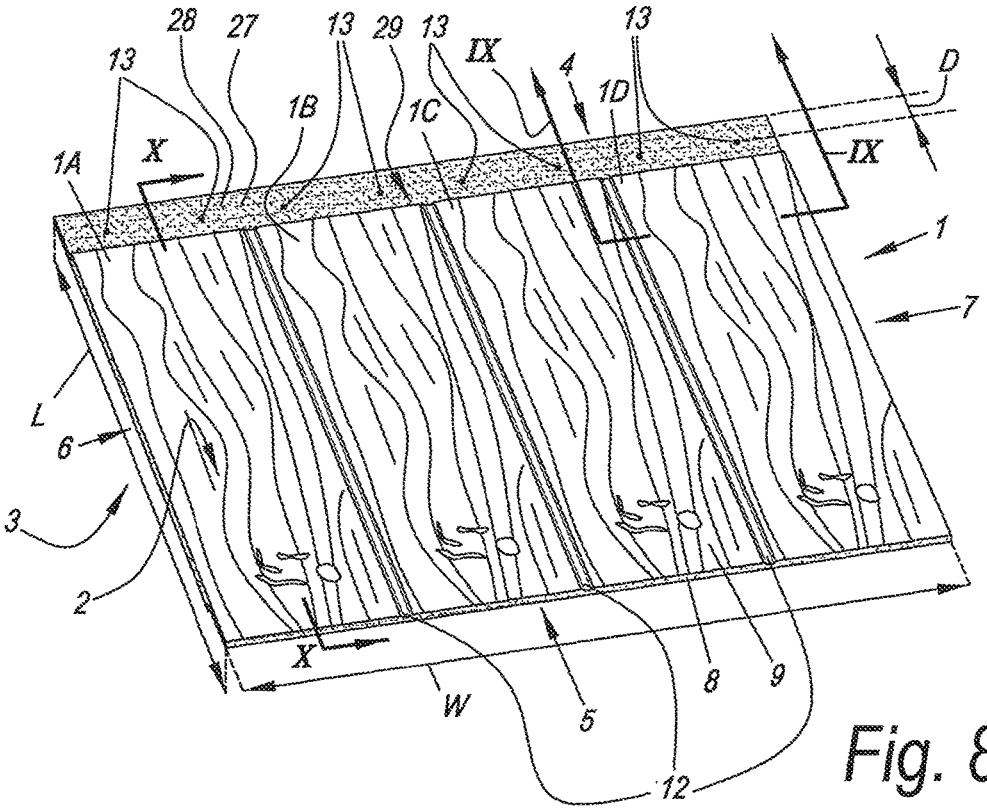
FIG. 8 represents a perspective view of an alternative roof tile according to the present invention, with a view on the front face of the roof tile, in accordance with an exemplary embodiment of the disclosure.

FIG. 8 represents a perspective view of an alternative roof tile 1 according to the present invention, with a view on the front face of the roof tile 1.

The roof tile 1 comprises a layer 27, which is situated below the ceramic body 8.

Said layer 27 is preferably made of a material different from ceramic or porcelain. In particular, it preferred that said layer 27 is made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer.

The layer 27 has a part 28 which extends beyond the ceramic body 8, and which is provided with attachment holes 13. In the represented example, the part 28 extends beyond the upper edge 29 of the ceramic body 8.

The attachment holes 13 are situated closer to the upper edge 4 of the roof tile 1 than to the lower edge 5 of the roof tile 1. In particular, the attachment holes 13 are situated at a distance D from the upper edge 4 of the roof tile 1, as measured in the length direction of the roof tile 1, which is smaller than 0.25 times the length L of the roof tile 1.

Figure 9:
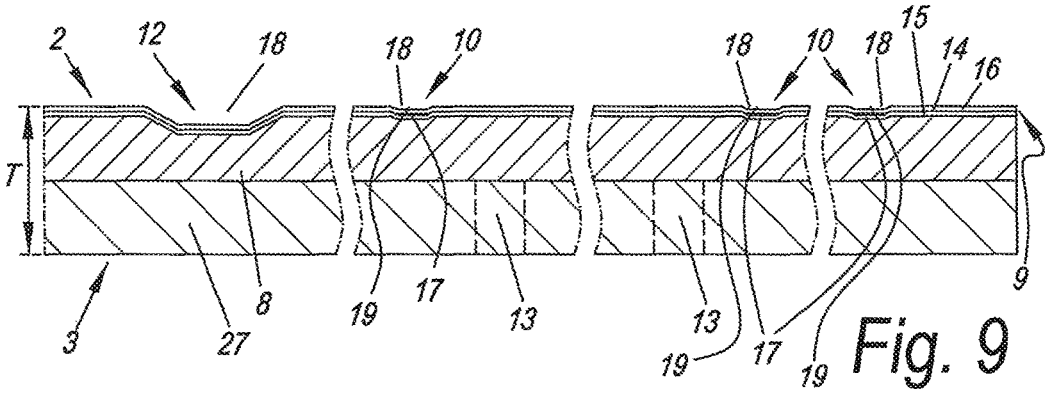
FIG. 9 represents an enlarged cross-section according to line IX-IX in FIG. 8, in accordance with an exemplary embodiment of the disclosure.

FIG. 9 represents an enlarged cross-section according to line IX-IX in FIG. 8.

The layer 27 is situated directly below the ceramic body 8, whereby it is not excluded that an adhesive layer such as glue is present between said layer 27 and the ceramic body 8. The layer 27 and the ceramic body 8 may be laminated or press laminated together, for example by means of glue such as epoxy glue.

The ceramic body 8 forms between 25% and 75% of the thickness T of the roof tile 1 and preferably between 40% and 60% of the thickness T of the roof tile 1. The layer 27 forms between 25% and 75% of the thickness T of the roof tile 1 and preferably between 40% and 60% of the thickness T of the roof tile 1.

Figure 10:
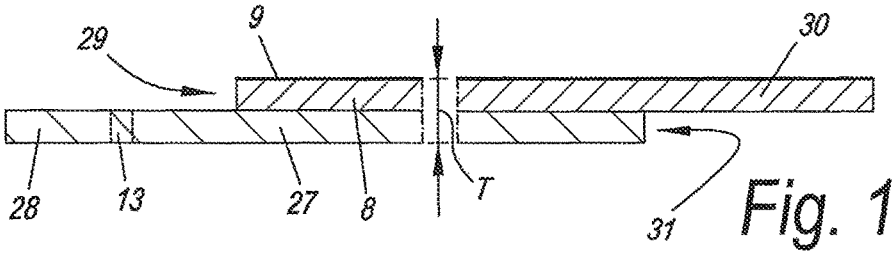
FIG. 10 represents an enlarged cross-section according to line X-X in FIG. 8, in accordance with an exemplary embodiment of the disclosure.

FIG. 10 represents an enlarged cross-section according to line X-X in of FIG. 8.

The layer 27 and the ceramic body 8 are offset with respect to each other in the length direction of the roof tile 1. In particular, part 28 of the layer 27 extends beyond the upper edge 29 of the ceramic body 8, whereas part 30 of the ceramic body 8 extends beyond the slower edge 31 of said layer 27.

It is noted that the structure of the glaze coating 9 is not represented in detail in FIG. 10.

Figure 11:
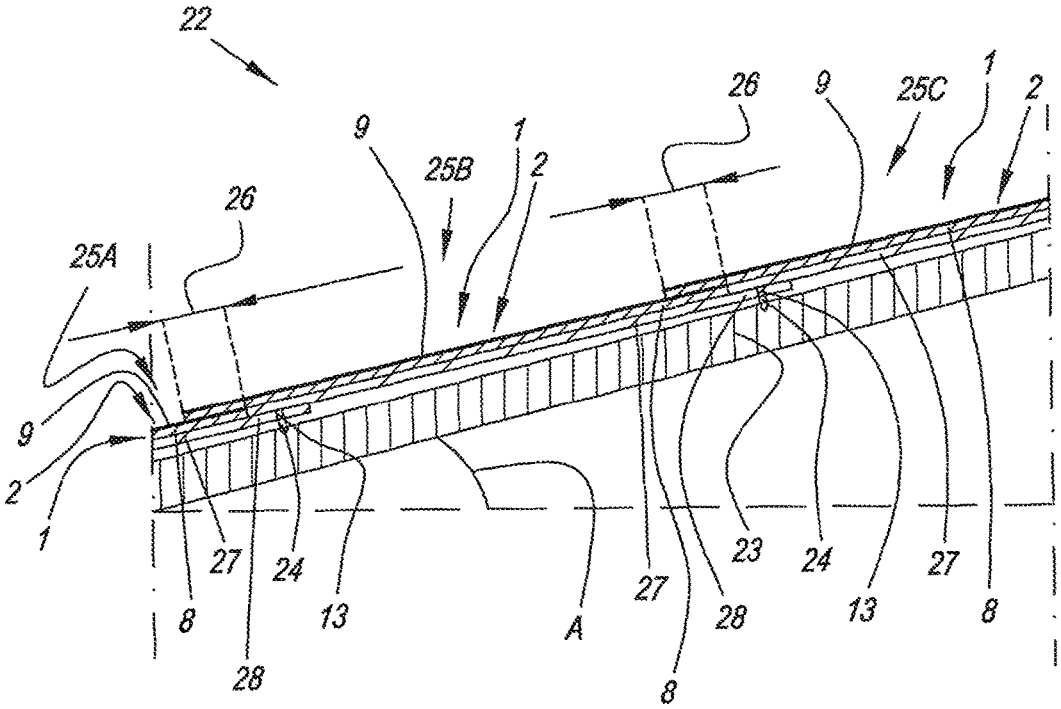
FIG. 11 represents a cross-sectional side view of part of an installed roof covering with roof tiles according to FIG. 8, in accordance with an exemplary embodiment of the disclosure.

FIG. 11 represents a cross-sectional side view of part of an installed roof covering 22 with roof tiles according to FIG. 8.

The roof tiles 1 are attached or fastened to a framework 23 by means of nails 24, which are put in the attachment holes 13, which are situated in the layer 27, in particular in part 28 of said layer 27.

The roof tiles 1 are installed in subsequent rows, of which only a few are represented in FIG. 11, namely the subsequent rows 25A-25B-25C. In particular, the roof tiles 1 are installed such that the roof tiles 1 of one row partially overlap the roof tiles of a previous row. For example, the roof tiles 1 of row 25C and 25B respectively overlap the roof tiles 1 of previous row 25B and 25A.

The overlap 26 between the roof tiles 1 of the respective rows is less than 20%. Or, in other words, the roof tiles 1 of row 25C and 25B respectively overlap the roof tiles 1 of previous row 25B and 25A, whereby the overlap 26 is such that less than 20% of the upper surface 2 of the roof tiles 1 of row 25A and 25B is covered by the roof tiles 1 of row 25B and 25C respectively.

In the represented example, the upper surface 2 of the roof tiles 1 denotes the upper surface 2 of the glaze coating 9. In other words, the upper surface 2 is formed by the decorative surface of the roof tiles 1.

A denotes the inclination of the roof with respect to the horizontal.

It is noted that the structure of the glaze coating 9 is not represented in detail in FIG. 11.

Figure 12:
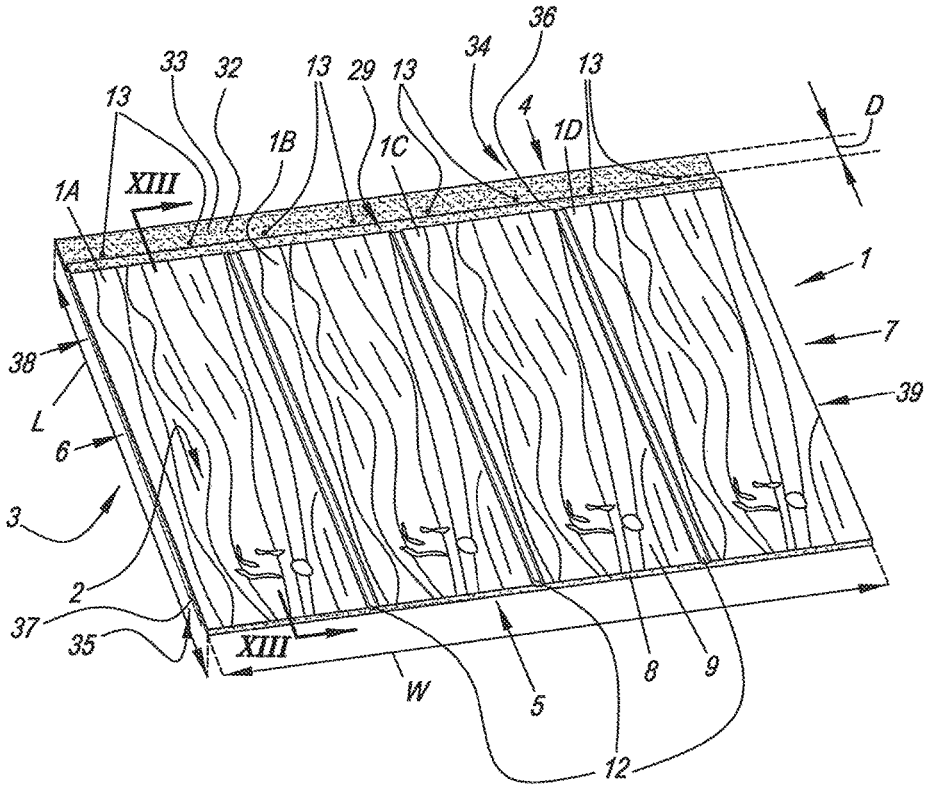
FIG. 12 represents a perspective view of an alternative roof tile of the present invention, with a view on the front face of the roof tile, in accordance with an exemplary embodiment of the disclosure.

FIG. 12 represents a perspective view of an alternative roof tile 1 of the present invention, with a view on the front face of the roof tile 1.

The roof tile 1 comprises a layer 32, which is situated below the ceramic body 8.

Said layer 32 is preferably made of a material different from ceramic or porcelain. In particular, it preferred that said layer 32 is made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer.

The layer 32 has a part 33 which extends beyond the ceramic body 8, and which is provided with attachment holes 13. In the represented example, the part 33 extends beyond the upper edge 29 of the ceramic body 8.

The attachment holes 13 are situated closer to the upper edge 4 of the roof tile 1 than to the lower edge 5 of the roof tile 1. In particular, the attachment holes 13 are situated at a distance D from the upper edge 4 of the roof tile 1, as measured in the length direction of the roof tile 1, which is smaller than 0.25 times the length L of the roof tile 1.

The layer 32, at least at two opposite edges 34-35, is provided with coupling parts 36-37, which allow that two of such roof tiles 1 can be coupled to each other.

In the represented example, the opposite edge 34-35, at which the coupling parts 36-37 are provided, concern the upper and lower edge of the layer 32.

In a not represented embodiment of the invention, instead of the edges 34-35, the opposite side edges 38-39 may be provided with coupling parts. Or, in another not represented embodiment of the invention, both pairs of edges 34-35 and 38-39 may be provided with coupling parts.

Figure 13:
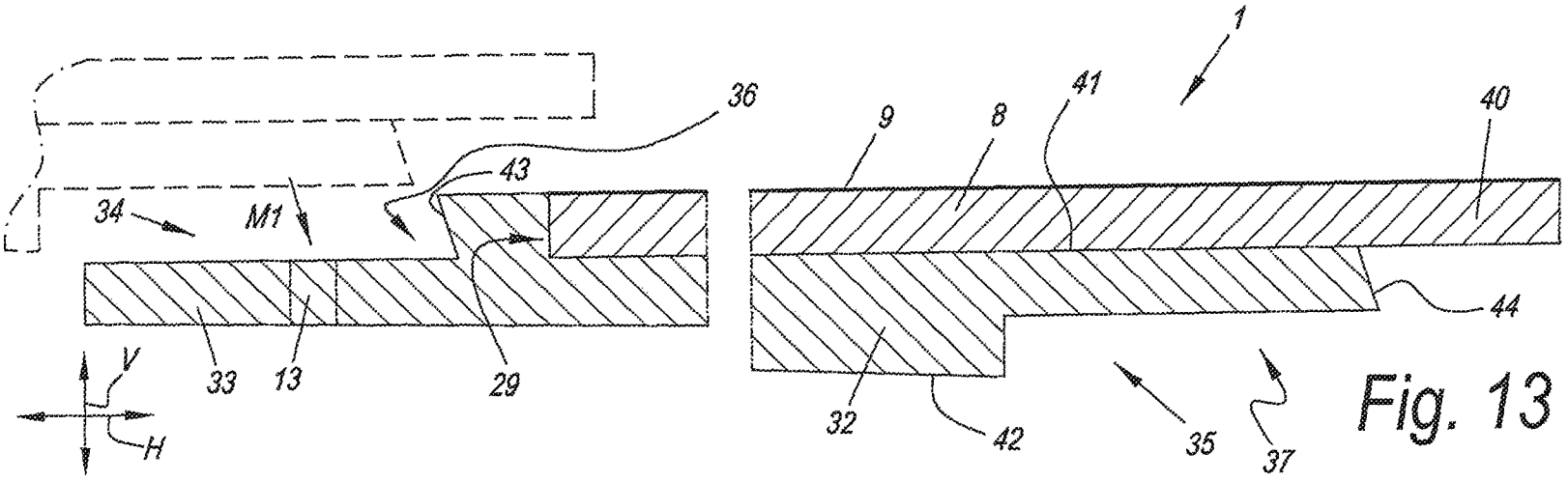
FIG. 13 represents an enlarged cross-section according to line XIII-XIII in FIG. 12, in accordance with an exemplary embodiment of the disclosure.

FIG. 13 represents an enlarged cross-section according to line XIII-XIII in FIG. 12.

The layer 32 is situated directly below the ceramic body 8, whereby it is not excluded that an adhesive layer such as glue is present between said layer 32 and the ceramic body 8. The layer 32 and the ceramic body 8 may be laminated or press laminated together, for example by means of glue such as epoxy glue.

The ceramic body 8 forms between 25% and 75% of the thickness T of the roof tile 1 and preferably between 40% and 60% of the thickness T of the roof tile 1. The layer 32 forms between 25% and 75% of the thickness T of the roof tile 1 and preferably between 40% and 60% of the thickness T of the roof tile 1.

The layer 32 and the ceramic body 8 are offset with respect to each other in the length direction of the roof tile 1. In particular, part 33 of the layer 32 extends beyond the upper edge 29 of the ceramic body 8, whereas part 40 of the ceramic body 8 extends beyond the lower edge 35 of said layer 32.

In the represented example, the upper edge 34, with its associated coupling part 36, is situated completely beyond the ceramic body 8, whereas the ceramic body 8 extends completely beyond the lower edge 35.

The upper surface 41 and the lower surface 42 of said layer 32 converge towards each other. In particular, they converge towards each other in the direction towards the upper edge 34 of said layer 32.

In the represented example, the coupling parts 36-37 are formed in the material of the layer 32. They are provided with a locking system, which, in the coupled condition of two of such roof tiles 1, is only active in the direction V perpendicular to the plane of the roof covering, which means that the moving apart of two of such coupled roof tiles 1 in said direction V is counteracted and preferably prevented. The locking system comprises locking surfaces 43-44, which, in the coupled condition, cooperate with each other to counteract the moving apart of the coupled roof tiles 1 in said direction V.

The coupling parts 36-37 are configured such that they allow to couple two of such roof tiles 1 by means of a substantially downward movement M1 of one roof tile 1 with respect to the other roof tile 1.

Figure 14:
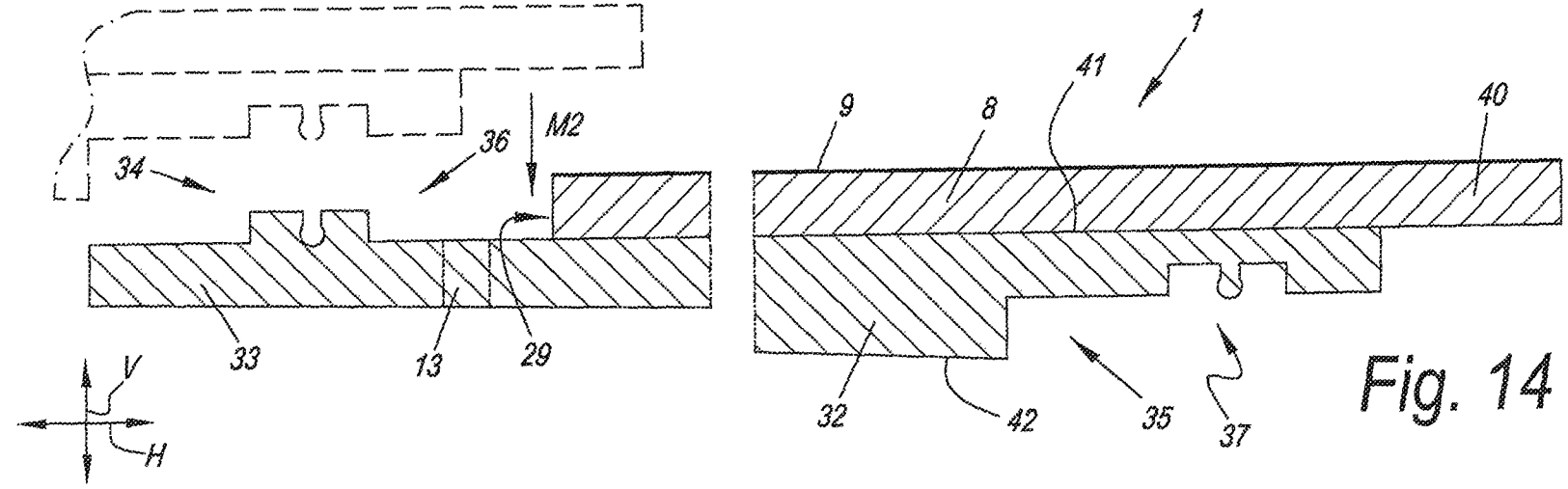
FIG. 14 represents a variant of the embodiment of FIG. 13, in accordance with an exemplary embodiment of the disclosure.

FIG. 14 represents a variant of the embodiment of FIG. 13.

In the represented example, the coupling parts 36-37 are provided with a locking system, which, in the coupled condition of two of such roof tiles 1, is active in the direction H parallel to the plane of the roof covering and perpendicular to the coupled edges 34-35 as well as in the direction V perpendicular to the plane of the roof covering, which means that the moving apart of two of such coupled roof tiles 1 in said directions H and V is counteracted and preferably prevented.

Here, the coupling parts 36-37 provide for a click-type or snap-type coupling. This means that a click or snap action occurs upon coupling two of such roof tiles at the respective edges 34-35.

The coupling parts 36-37 are configured such that they allow to couple two of such roof tiles 1 by means of a downward movement M2 of one roof tile 1 with respect to the other roof tile 1. In the example, they are of the so-called push-lock or push-down type, known per se from the field of flooring.

Figure 15:
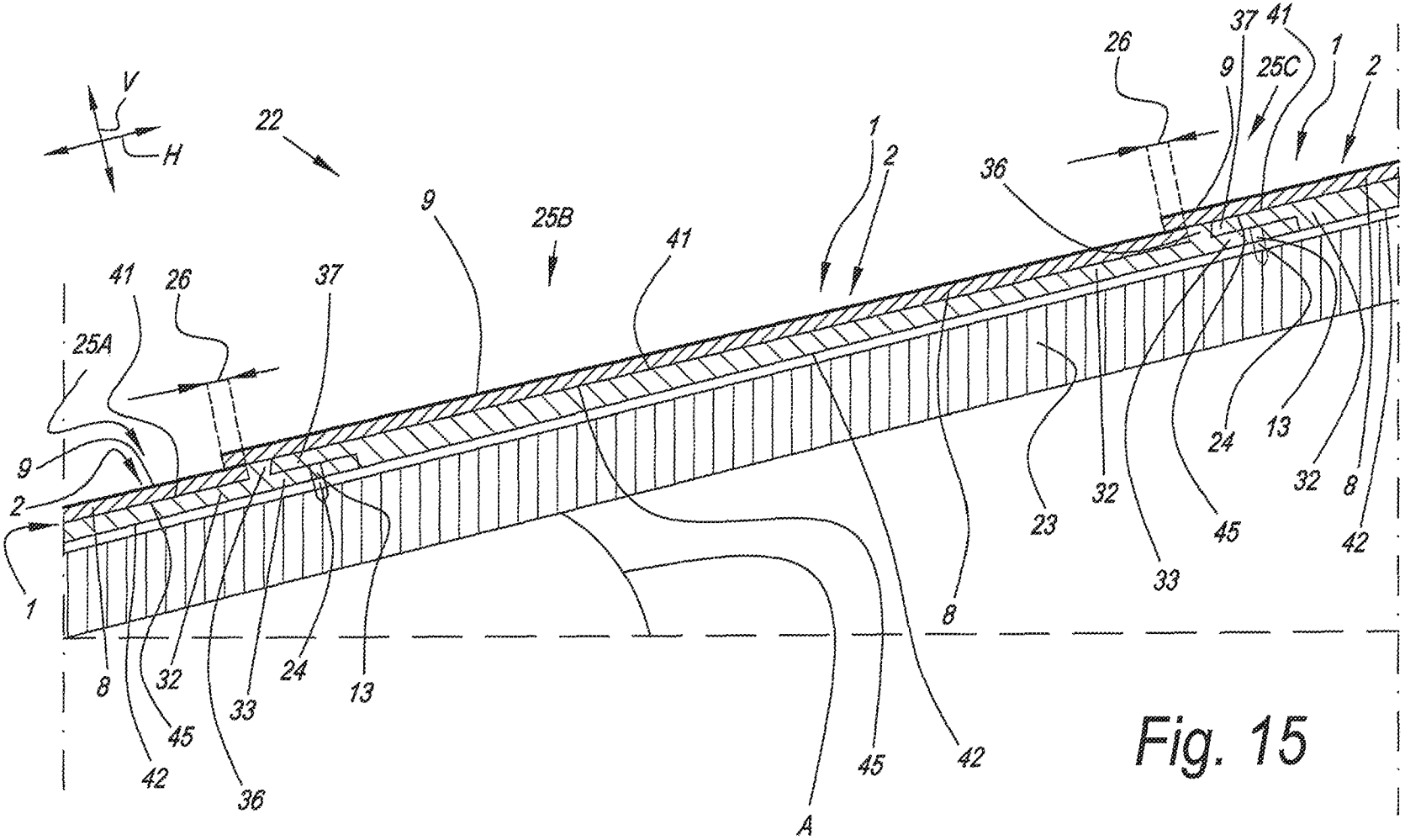
FIG. 15 represents a cross-sectional side view of part of an installed roof covering with roof tiles according to FIG. 12, in accordance with an exemplary embodiment of the disclosure.

FIG. 15 represents a cross-sectional side view of part of an installed roof covering with roof tiles according to FIG. 12.

The roof tiles 1 are attached or fastened to a framework 23 by means of nails 24, which are put in the attachment holes 13, which are situated in the layer 32, in particular in part 33 of said layer 32.

The roof tiles 1 are installed in subsequent rows, of which only a few are represented in FIG. 15, namely the subsequent rows 25A-25B-25C. In particular, the roof tiles 1 are installed such that the roof tiles 1 of one row partially overlap the roof tiles of a previous row. For example, the roof tiles 1 of row 25C and 25B respectively overlap the roof tiles 1 of previous row 25B and 25A.

The overlap 26 between the roof tiles 1 of the respective rows is less than 20%. Or, in other words, the roof tiles 1 of row 25C and 25B respectively overlap the roof tiles 1 of previous row 25B and 25A, whereby the overlap 26 is such that less than 20% of the upper surface 2 of the roof tiles 1 of row 25A and 25B is covered by the roof tiles 1 of row 25B and 25C respectively.

In the represented example, the upper surface 2 of the roof tiles 1 denotes the upper surface 2 of the glaze coating 9. In other words, the upper surface 2 is formed by the decorative surface of the roof tiles 1.

The coupling parts 36-37 allow coupling the roof tiles 1 lying adjacent to each other in subsequent rows 25A-25B-25C of the roof covering 22.

The upper surface 41 and the lower surface 42 of said layer 32 converge towards each other. Here, they converge towards each other in the direction towards the upper edge 34 of said layer 32.

In the represented example, the upper surface 41 of the layer 32 is substantially parallel to the lower surface 45 of the ceramic body 8, whereas the lower surface 42 of said layer 32 is configured such that, in the installed condition of the roof tile 1, it is substantially parallel to the slope of the roof. Here, the lower surface 42 of said layer 32 is arranged such that, in the installed condition of the roof tiles 1 in subsequent rows 25A-25B-25C, the lower surfaces 42 of the respective layers 32 of these roof tiles 1 form a generally flat surface. In other words, the transition from the lower surface 42 of the layer 32 of the roof tile 1 in row 25A and 25B to the lower surface 42 of the layer 32 of the roof tile 1 in respectively row 25B and 25C is flush or substantially flush.

A denotes the inclination of the roof with respect to the horizontal.

It is noted that the structure of the glaze coating 9 is not represented in detail in FIG. 15.

Figure 16:
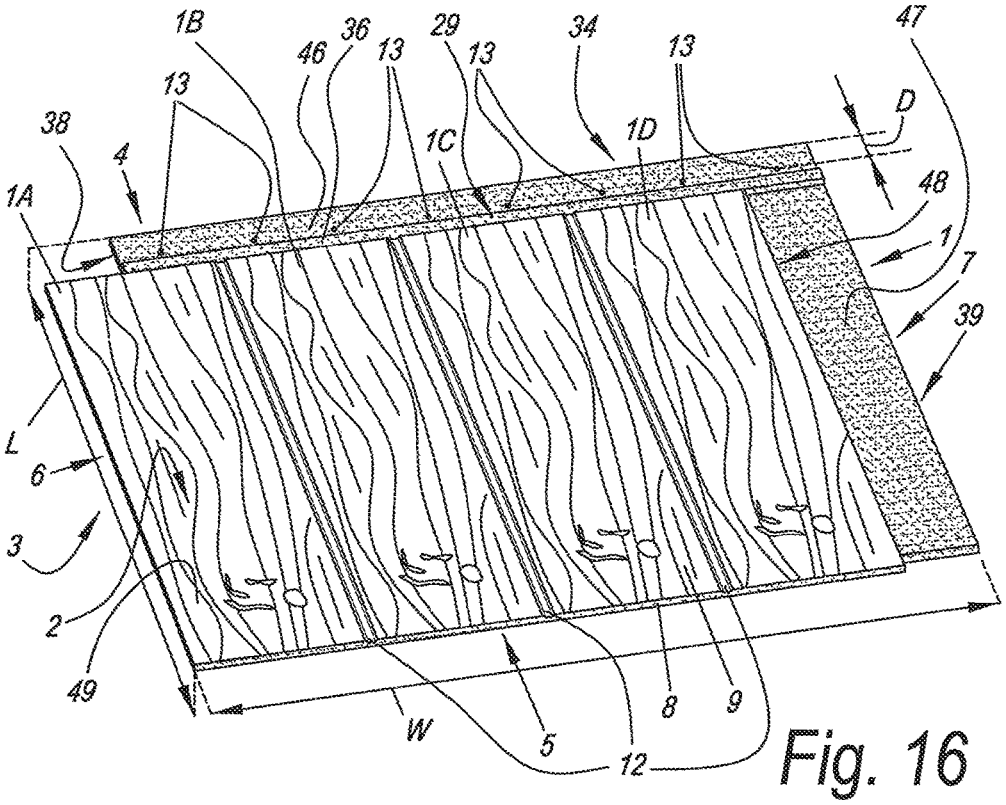
FIG. 16 represents a perspective view of an alternative roof tile of the present invention, with a view on the front face of the roof tile, in accordance with an exemplary embodiment of the disclosure.

FIG. 16 represents a perspective view of an alternative roof tile 1 of the present invention, with a view on the front face of the roof tile 1.

The roof tile 1 comprises a layer 46, which is situated below the ceramic body 8. The layer 46 is similar to the layer 32 represented in FIG. 12, however, whereby the layer 46 is offset with respect to the ceramic body 8 in the width direction of the roof tile 1 as well.

The layer 46 has a part 47, which extends beyond the side edge 48, whereas the ceramic body 8 has a part 49, which extends beyond the side edge 38 of said layer 46.

Figure 17:
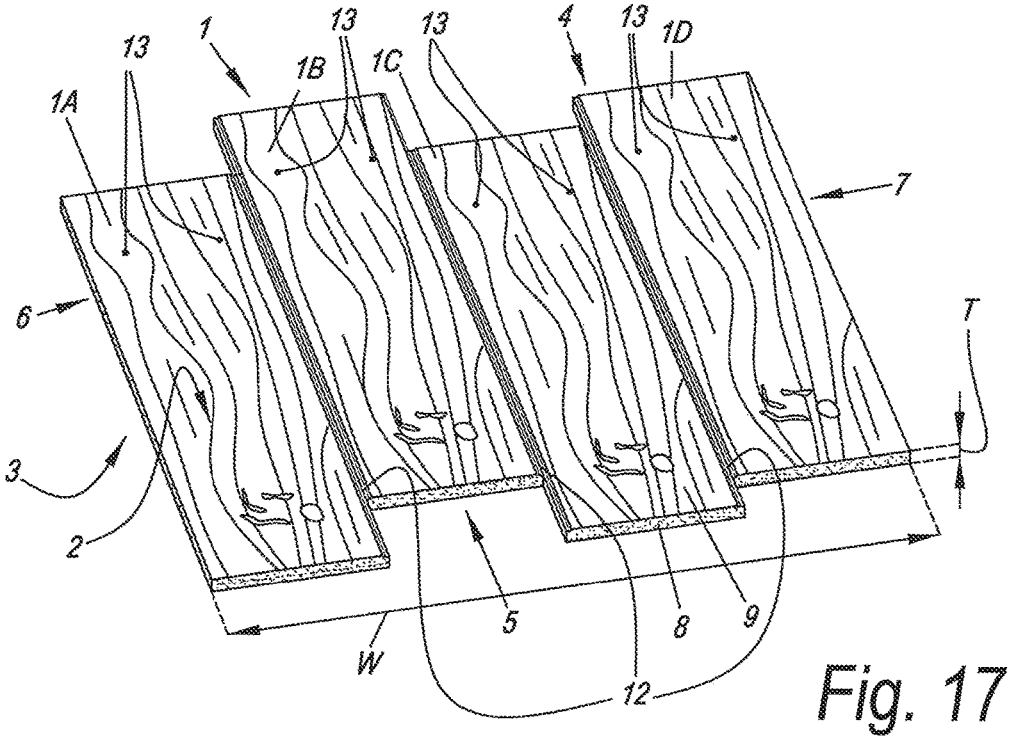
FIG. 17 represents a perspective view of another alternative roof tile of the present invention, with a view on the front face of the roof tile, in accordance with an exemplary embodiment of the disclosure.

FIG. 17 represents a perspective view of another alternative roof tile 1 of the present invention, with a view on the front face of the roof tile 1.

In the represented example, instead of being mainly rectangular, the roof tile 1 has an irregular shape. In particular, the front face of the roof tile 1 represents a plurality of staggered roof tiles 1A-1B-1C-1D.

In such case, the length of the roof tile 1 is to be interpreted as the average length of the roof tile 1.

Figure 18:
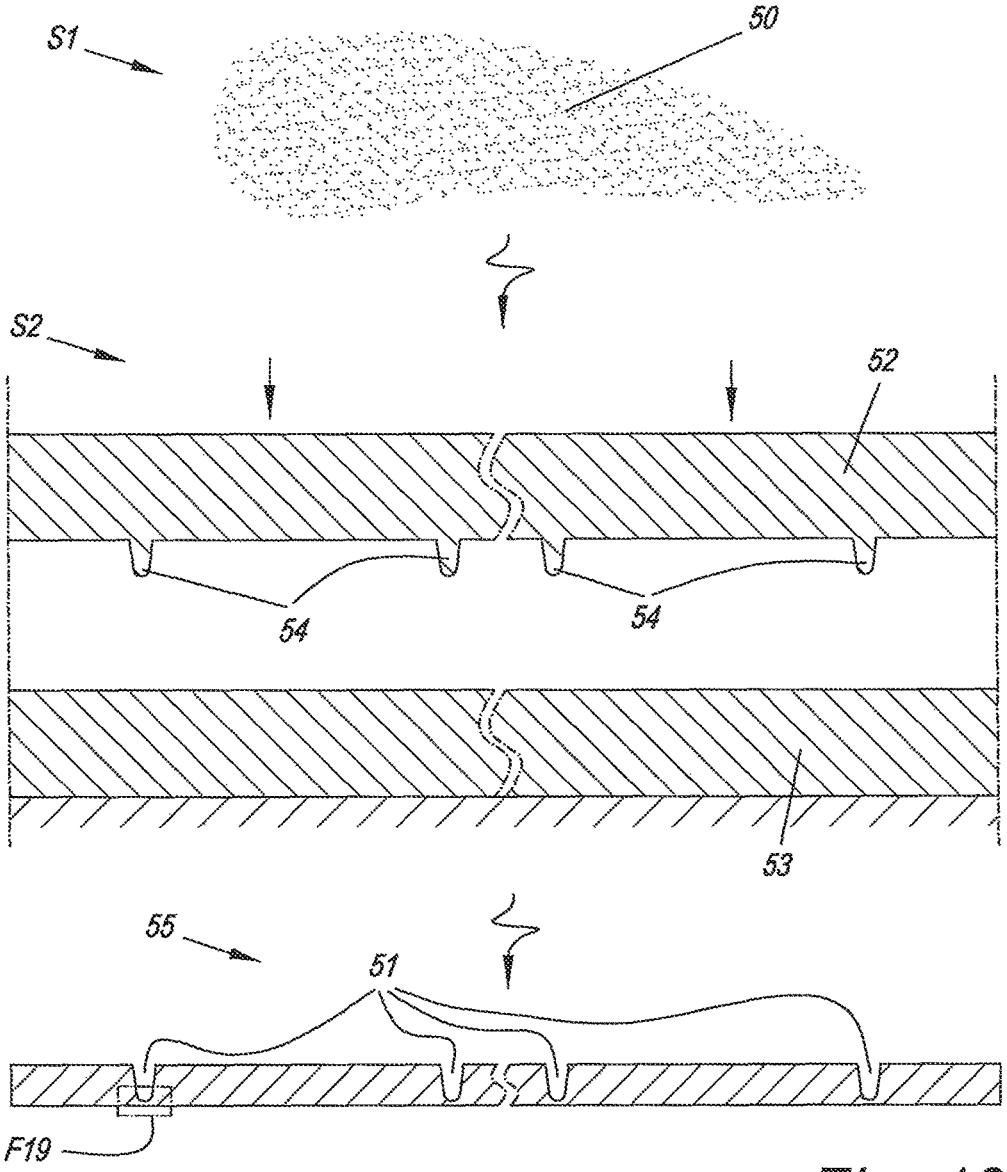
FIG. 18 represents some steps in a method for manufacturing the roof tile of FIG. 1, the method being in accordance with the present invention, in accordance with an exemplary embodiment of the disclosure.

FIG. 18 represents some steps in a method for manufacturing the roof tile 1 of FIG. 1, the method being in accordance with the present invention.

In particular, the step S1 of providing a body composition 50, which here is formed by body powder, and the step S2 of pressing the body composition 50 are represented.

For forming the attachment holes 13, before the step of firing, recesses 51 are formed in the ceramic body 8 in the form of blind holes or through holes. Here, recesses 51 are formed in the form of blind holes.

In the represented example, the blind holes are formed in said step S2 of pressing. In particular, the body composition 50 is pressed between an upper press element 52 and a lower press element 53, which are provided with means for forming said blind holes. Here, said means are formed by protrusions 54 present at the upper press element 52, the length of which being smaller than the thickness of the ceramic body 8.

The step S2 of pressing is preferably performed with the upper surface 20 of the ceramic body 8 facing upwards or, in other words, with the upper surface 20 of the ceramic body 8 facing towards the upper press element 52.

The blind holes that are formed prior to firing the pressed body composition 55 preferably constitute at least 50%, more preferably at least 75%, and still more preferably at least 90% of the length of said attachment holes 13.

The through holes can be made from the blind holes before the step of firing or after the step of firing, which through holes then correspond to said attachment holes 13. For example, the through holes may be made by means of stamping, before or after the step of firing. As alternative, the through holes may be made upon installing the roof tile, e.g. by punching/hammering a nail or turning a screw into the blind hole, which then removes the remaining part.

Figure 19:
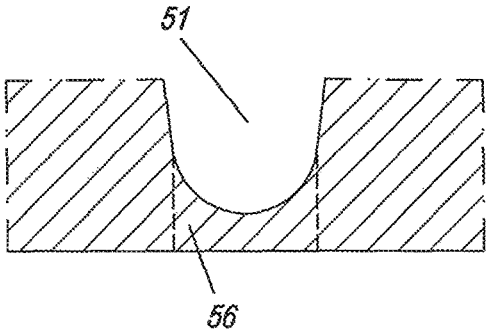
FIG. 19 represents an enlarged view of the section that is indicated with F19 in FIG. 18, in accordance with an exemplary embodiment of the disclosure.

FIG. 19 represents an enlarged view of the section that is indicated with F19 in FIG. 18, whereby the part 56 that still needs to be removed for forming the through hole is clearly made visible.

The present invention is in no way limited to the hereinabove described embodiments, but such roof tiles and methods may be realized according to different variants without leaving the scope of the present invention.

We claim:

1. A roof tile for forming a roof covering, the roof tile comprising:

a ceramic body made of porcelain;

a glaze coating situated above the ceramic body, and a second layer situated below said ceramic body, wherein said second layer is made of one or more materials selected from the group consisting of a thermoplastic polymer, a thermosetting polymer, and an elastomer, and wherein the glaze coating comprises (i) a décor comprising a print and (ii) a transparent or translucent glaze layer arranged over the print, and wherein the roof tile has a water absorption rate of less than 0.5% measured according to the norm ASTM C373, and wherein the décor represents or forms an image of a plurality of roof tiles providing a reduced risk of water penetration.

2. The roof tile according to claim 1, wherein the roof tile has a hail impact rating of class 3 or higher measured according to the norm FM 4473.

3. The roof tile according to claim 1, wherein the roof tile comprises a reinforcement layer, which is situated below said ceramic body, said reinforcement layer being formed by a mesh.

4. The roof tile according to claim 3, wherein said reinforcement layer is embedded in said second layer.

5. The roof tile according to claim 1, wherein the thickness of said roof tile is located between 5 mm and 20 mm.

6. The roof tile according to claim 1, wherein the width of the roof tile is larger than its length.

7. The roof tile according to claim 1, wherein the roof tile is at least 350 mm wide.

8. The roof tile according to claim 1, wherein the roof tile is provided with at least one attachment hole, said at least one attachment hole being present in at least said ceramic body.

9. The roof tile of claim 1, wherein the décor is digitally printed.

10. The roof tile of claim 1, wherein the print resembles a natural product.

11. The roof tile of claim 1, wherein the décor comprises a plurality of images separated by a depression in the ceramic tile.

12. A roof tile for forming a roof covering, the roof tile comprising:

a ceramic body made of porcelain;

a reinforcement layer situated below said ceramic body;

at least one attachment hole present in at least said ceramic body;

a glaze coating, situated above the ceramic body, and a second layer situated below said ceramic body, wherein said second layer is made of one or more materials selected from the group consisting of a thermoplastic polymer, a thermosetting polymer, and an elastomer, and wherein the glaze coating comprises (i) a décor comprising a print and (ii) a transparent or translucent glaze layer arranged over the print, and wherein the roof tile has a water absorption rate of less than 0.5% measured according to the norm ASTM C373, and wherein the thickness of said roof tile is located between 5 mm and 20 mm, and wherein the roof tile is at least 350 mm wide.

13. The roof tile according to claim 12, wherein the roof tile is at least 500 mm wide.

14. The roof file according to claim 12, wherein said reinforcement layer is embedded in said second layer.

* * * * *